US005953572A

United States Patent [19]

Takeuchi et al.

[11] Patent Number: 5,953,572

[45] Date of Patent: Sep. 14, 1999

[54] IMAGE FORMING APPARATUS HAVING INTERMEDIARY TRANSFER MEMBER

[75] Inventors: Akihiko Takeuchi, Susono; Tatsuya Kobayashi, Sohka; Toshiaki Miyashiro, Shizuoka-ken; Naoki Enomoto, Susono; Takaaki Tsuruya, Mishima, all of Japan

[73] Assignee: Canon Kabushiki Kaisha, Tokyo, Japan

[21] Appl. No.: 08/905,830

[22] Filed: Aug. 4, 1997

[30] Foreign Application Priority Data

Aug. 2, 1996 [JP] Japan ..... 8-220446
Jul. 24, 1997 [JP] Japan ..... 9-198344

[51] Int. Cl.[6] ..... G03G 15/16

[52] U.S. Cl. ..... 399/302; 399/66; 399/308

[58] Field of Search ..... 399/9, 31, 302, 399/308, 312–313, 66

[56] References Cited

U.S. PATENT DOCUMENTS 5,287,144 2/1994 Takeda ..... 399/66
5,701,566 12/1997 Bisaiji et al. ..... 399/302
5,752,130 5/1998 Tanaka et al. ..... 399/308 X
5,802,442 9/1998 Konno et al. ..... 399/308

FOREIGN PATENT DOCUMENTS 8-115002 5/1996 Japan .

*Primary Examiner*—Arthur T. Grimley
*Assistant Examiner*—Quana Grainger
*Attorney, Agent, or Firm*—Fitzpatrick, Cella, Harper & Scinto

[57] ABSTRACT

An image forming apparatus includes an image bearing member for bearing an image; an intermediary transfer member onto which an image is transferred from the image bearing member at a first transfer position and from which the image thus transferred is transferred onto a transfer material at a second transfer position; a contact member provided at an image bearing side of the intermediary transfer member, the contact member being capable of forming a nip between the intermediary transfer member; a supporting member for supporting the intermediary transfer member at a position opposite from the nip; a sum of a resistance value of the contact member and a resistance value of the supporting member is not more than 1/10 of a resistance value of the intermediary transfer member; and the contact member and the supporting member are contacted to the intermediary transfer member, and when no transfer material is present at the nip, a voltage is detected while a predetermined current is applied between the contact member and the supporting member through the intermediary transfer member.

82 Claims, 4 Drawing Sheets

IMAGE FORMING APPARATUS HAVING INTERMEDIARY TRANSFER MEMBER

FIELD OF THE INVENTION AND RELATED ART

The present invention relates to an image forming apparatus in which images formed on an image bearing member are transferred onto an intermediary transfer member, and thereafter, the images having been transferred onto the intermediary transfer member are transferred onto a sheet of transfer material. The present invention produces the desirable results, in particular, when applied to a copy machine, a printer, or the like.

There are various image forming systems employable as the image forming system for a color forming apparatus; for example, an electrophotographic system, a thermal transfer system, and an ink jet system. Among various color image forming apparatuses, those employing the electrophotographic system are superior to the others in terms of speed, picture quality, noise, and the like, and therefore, have become increasingly popular in recent years. The electrophotographic system has its own variations. For example, there are: a multilayer development system in which color images are cumulatively formed on the peripheral surface of a photosensitive member, and then, are transferred all at once onto a transfer material; a multilayer transfer system in which an image forming cycle comprising a developing process and a transferring process is repeated; and an intermediary transfer system in which developed images of a different color are sequentially transferred onto an intermediary transfer member, and then, are transferred all at once onto a transfer material. Among them, the intermediary transfer system has been attracting attention because it is less troublesome in terms of color mix-up, and is compatible with various media.

An example of an intermediary transfer system is depicted in FIG. 5. In the drawing, a charging device 102, a plurality of developing devices 105 (black), 106 (magenta), 107 (cyan), and 108 (yellow), an intermediary transfer belt 109 as an intermediary transfer member, and a cleaner 119 are disposed adjacent to the peripheral surface of a photosensitive drum 101 as an image bearing member, in a manner to surround the photosensitive drum 101. The developing devices 106–108 are supported so that they can be placed in contact with photosensitive drum 1 by an unillustrated means as needed.

In order to form an image, the photosensitive drum 101 is exposed to the light projected from a charge removing exposure lamp 117, and then is uniformly charged by the charging device 102. Next, the charged surface of the photosensitive drum 101 is exposed to the scanning light 104 projected from a laser based optical system 103. As a result, a latent image correspondent to an original image is formed.

Next, the latent image is developed by one of the plurality of developing devices, for example, the developing device 105, and the developed image is transferred (primary transfer process) onto the intermediary transfer belt 109 as the first transferring means by a primary transfer roller 110. The preceding steps are repeated for the rest of the colors using the rest of the developing devices to cumulatively form four color images of a different color on the intermediary transfer belt 109. Then, a secondary transfer roller 111 as the secondary transferring means is pressed onto the intermediary transfer belt 109, with a transfer material 118 being interposed between the secondary transfer roller 111 and the intermediary transfer belt 109, so that a full-color image is transferred (secondary transfer process) onto the transfer material 118. The primary and secondary transfer processes will be described later in detail.

When the photosensitive drum 101 is of a negatively chargeable organic photoconductor type, the latent image formed on the peripheral surface of the photosensitive drum 101 by the scanning light 104 is developed by one of the developing devices 105–108 which employ negatively chargeable toner. In this embodiment, the image is reversely developed. Therefore, in order to transfer the image developed on the photosensitive drum 101 onto the intermediary transfer belt 109 (primary transfer process), positive primary transfer bias is applied to the primary transfer roller 110 from a bias power source 120.

The intermediary transfer belt 109 is formed of polyvinylidene film, nylon film, polyethylene terephthalate film, polycarbonate film or the like. Its thickness is in a range of 100–200 $\mu$m. The volumetric resistivity of the belt is in a range of $10^{11}$–$10^{16}$ ohm.cm (adjusted as needed). As the primary transfer roller 110, a roller whose volumetric resistivity is no more than $10^5$ ohm.cm is generally used. Usage of thin film as the intermediary transfer belt 109 as described above affords a large electrostatic capacity ranging from several hundred to several thousand pF at a primary transfer nip, that is, the position at which the primary transfer process is carried out, and therefore, makes it possible to provide stable primary transfer current.

In the secondary transfer process, the secondary transfer bias, which is positive bias, is applied to a roller 112, that is, an electrode which opposes the secondary transfer roller 111, from the bias power source 121, whereby the images on the intermediary transfer belt 109 are transferred onto the transfer material 118. The roller 112 has a low resistance and is pressed upon the secondary transfer roller 111, with the intermediary transfer belt 109 being interposed between the secondary transfer roller 111 and the roller 112. The roller 112 is grounded, or a proper amount of bias is applied to the roller 112. The secondary transfer roller 111 also has a low resistance.

After the completion of the first and secondary transfer processes, the toner which remains on the intermediary transfer belt 109 after the secondary transfer is recovered by the cleaner 113, and the charge remaining on the intermediary transfer belt 109 is removed by a charge removing charging device 114. As the charge removing charging device 114, a corona type charging device, to which an AC voltage is applied, is widely used. Generally speaking, in order to improve discharging efficiency, an electrode is disposed on the opposite side of the intermediary transfer belt 109 relative to the charge removing charging device 114. The toner which remains on the photosensitive drum 101 after the primary transfer process is recovered by the cleaner 119. Thereafter, the photosensitive drum 101 is initialized by the charge removing exposure lamp 117 to be prepared for the following image formation. Referring again to FIG. 5, a roller 116 is a tensioner roller which provides the intermediary transfer belt 109 with a predetermined amount of tension. A roller 115 drives the intermediary transfer belt 109.

In some cases, an intermediary transfer drum is employed as the intermediary transfer member, in place of the intermediary transfer belt 109. Generally speaking, an intermediary transfer drum is superior in durability, whereas an intermediary transfer belt is superior in the latitude in positioning an intermediary transfer member in an image forming apparatus, and the separativeness of transfer material from the intermediary transfer member after the secondary transfer (transfer material can be separated from the intermediary transfer member using the difference in curvature).

In the case of an intermediary transfer belt system in accordance with the prior art, a belt with a relatively high resistance is employed as an intermediary transfer belt. Therefore, the intermediary transfer belt according to the prior art has merit in that there is no interference between the primary and secondary transfer bias; various functional stations can remain independent from each other.

However, the relatively high resistance of the intermediary transfer belt causes the intermediary transfer belt to become charged as the primary transfer process is repeated. As a result, when the toner images formed on the photosensitive drum 101 are sequentially and cumulatively transferred onto the intermediary transfer belt 109, the value of the primary transfer bias must be adjusted for each color in consideration of the amount of residual charge of the intermediary transfer belt 109 after each image transfer operation. This is the weakness of the intermediary transfer system.

Further, when a primary transfer bias is excessively high, electrical discharge occurs between the photosensitive drum 101 and the intermediary transfer belt 109 at the rear end of the nip, that is, the end at which the drum 101 and the belt 109 separate from each other, and as a result, the images on the intermediary transfer member are disturbed. According to the prior art, it was difficult to adjust the primary transfer bias to the optimum level. This is another problem of the intermediary transfer system in accordance with the prior art. Further, means for removing the aforementioned residual charge from the intermediary transfer belt 109 after each secondary transfer process was required. As a result, the apparatus structure became complicated, and therefore, it was difficult to reduce the cost.

On the other hand it is conceivable to disperse electrically conductive ingredients in the intermediary transfer belt 109 so that the resistance of the intermediary belt 109 is reduced to a level in a low to medium range, at which the aforementioned residual charge attenuates to a negligible level while any given point of the intermediary transfer belt 109 makes one full rotation. However, when the resistance value of the intermediary transfer belt 109 is rendered too small, electrical current is allowed to flow between the primary and secondary transfer stations; the primary and secondary transfer biases interfere with each other. Therefore, it becomes impossible to allow the primary and secondary transfer processes to overlap. In other words, the intermediary transfer belt 109 must be idled for a minimun of one rotation prior to each secondary transfer process, reducing thereby the throughput.

When the resistance value of the intermediary transfer belt 109 is rendered extremely small, it is liable that there is a danger that an excessively large amount of current flows between the secondary transfer roller 111 and the roller 112, that is, the counter-electrode (roller electrode), through the intermediary transfer belt 109, through the area outside the path of the transfer material 118. In order to prevent this problem, it is conceivable to substitute a constant current power source for the power source 121. However, the width of the transfer material varies, making it impractical to use only a single current value. In other words, in reality, it is impractical to employ a constant current power source.

The Japanese Official Gazette Tokkai No. 501170/1990 or the like proposes a method for preventing the transfer current interference between the primary and secondary transfer stations, and the occurrence of an excessively large current flow (leak) between the secondary transfer roller 111 and the counter roller 112 through the intermediary transfer belt 109. According to the proposal, a grounding electrode (unillustrated) is disposed in contact with the inward facing surface of the intermediary transfer belt 109, on the upstream side of the secondary transfer station relative to the direction in which the intermediary transfer belt 109 is moved, whereas the counter roller 112 is floated or given a high resistance, so that the secondary transfer current is caused to flow into this grounding electrode to stabilize image formation.

However, according to this method, a complicated structure is required, and also, the secondary transfer current is affected by both the surface resistance and volumetric resistivity of the intermediary transfer belt 109, making it difficult to properly set up the secondary transfer current. Further, the positioning and contact pressure of the aforementioned grounding electrode, relative to the intermediary transfer belt 109, affect the value of the secondary transfer current. Therefore, stable transfer performance cannot be realized.

The results of the studies conducted by the inventors of the present invention revealed that when the structure depicted in FIG. 5 was used to keep the actual resistance value of the intermediary transfer member in the primary transfer station within an approximate range of $1\times10^7$–$2\times10^9$ ohm., desirable primary transfer performance could be realized, without causing the aforementioned problems, and also, it was unnecessary to dispose an auxiliary electrode (unillustrated) like the aforementioned one in contact with the inward facing surface of the intermediary transfer belt 109. The resistance value of the intermediary transfer belt 109 was measured using a metallic drum in place of the photosensitive drum 101. The diameter of the metallic drum was rendered the same as that of the photosensitive drum 101, and the measurement was taken while rotating the intermediary transfer belt 109 at the same speed as the rotational speed for image formation.

However, generally speaking, it is difficult to stabilize the resistance value of the intermediary transfer member; it is difficult to keep the resistance value of the intermediary transfer member within a narrow range. As the resistance value is instable, the transfer current becomes instable. If the transfer current is stabilized during printing in order to prevent this problem, image formation is greatly affected, although this depends on the image pattern.

Obviously, there are other methods to obtain the resistance value of the intermediary transfer member. For example, it is conceivable to apply a bias identical to the primary transfer bias to the primary transfer roller 110 prior to an actual printing operation, and estimate the resistance value of an intermediary transfer member from the relationship between the primary transfer current and the voltage. However, this method cannot accurately detect the resistance value of an intermediary transfer member when the resistance value is near $1\times10^7$ ohm., in particular, on the lower side of $1\times10^7$ ohm.

This is due to the fact that the upper limit of the current which flows during a primary transfer process is predetermined, or fixed, by the electrostatic capacity of the photosensitive member 101. Therefore, when the resistance value of an intermediary transfer member is approximately the same, or no more than, the value of "apparent resistance" attributable to the photosensitive drum 101, it cannot be accurately measures since measurement error becomes too large.

A photosensitive drum is generally composed of such material that has a dielectric constant ($\epsilon$) in a range of 3–8. Therefore, the current (i) which flows into the photosensitive drum from a member, which is in contact with the photosensitive drum across the entire contact nip length L of approximately 200 mm, and is rotating at an image formation speed (vp) of approximately 100 mm/sec., is expressed by the following equation:

$$i=(\epsilon\cdot\epsilon_0\cdot vp\cdot L/d)\cdot V$$

v: applied voltage;

$\epsilon_0$: dielectric constant in vacuum;

d: thickness of photosensitive layer.

Therefore, the apparent resistance value R ($R=i/(\epsilon\cdot\epsilon_0\cdot vp\cdot L/d)$ under the above condition is in a range of $1\times10^7\times1\times10^8$ ohm. This range is substantially the same as the aforementioned desirable resistance value range for an intermediary transfer member, and therefore, causes a problem in terms of the control in the primary transfer station as descried above.

The Japanese Official Gazette Tokkai No. 212872/1990 discloses another method. According to this method, an electrode roller is disposed in contact with the inward facing surface of an intermediary transfer belt, outside and on the upstream side of the secondary transfer station, and the current which flows between the electrode roller and a transfer roller for the secondary transfer through the intermediary transfer belt is measured. The voltage to be applied to the transfer roller is set so that the measured value of the current becomes stable. When the thus set voltage is applied to the transfer roller, images are desirably transferred onto a transfer material even if external environmental factors, such as temperature, change. However, this method has the following problem.

Since the electrode roller is disposed away from the second transfer station, the amount of the fluctuation which occurs to the resistance value of the intermediary transfer member due to the external environment is not properly reflected upon the voltage value set as described above.

SUMMARY OF THE INVENTION

The present invention was made in view of the aforementioned problems, and its primary object is to accurately detect the resistance value of an intermediary transfer member regardless of the fluctuation of the resistance value caused by environmental changes.

Another object of the present invention is to provide an image forming apparatus capable of optimally controlling the image formation related conditions, such as image transfer condition, regardless of environment, using the results of the detection of the intermediary transfer member resistance.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described with reference to the drawings.

Embodiment 1

Figure 1:
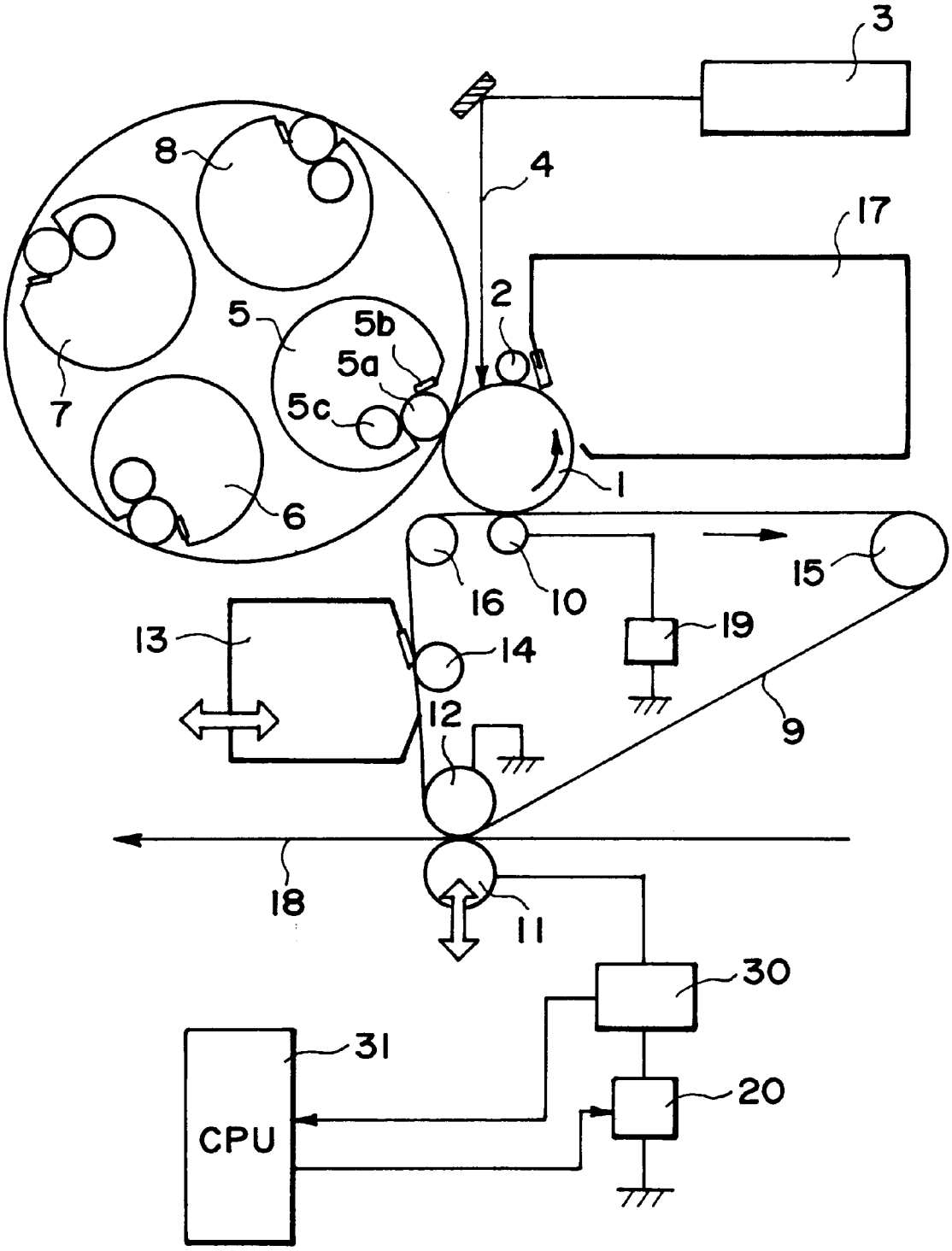
FIG. 1 is a schematic elevation of the image forming apparatus in the first embodiment of the present invention.

Referring to FIG. 1 which depicts the first embodiment of the present invention, the way a latent image is formed on the peripheral surface of an OPC type photosensitive member 1 as an image bearing member by the scanning laser beam 4 from a laser optical system 3 after the peripheral surface of the photosensitive member 1 is uniformly charged is the same as in the case of an image forming apparatus based on the prior art. Next, the latent image is developed by rotatively placing a magenta image developing device 5, a cyan image developing device 6, a yellow image developing device 7 or a black image developing device 8, and the developed image is transferred onto an intermediary transfer belt 9 as an intermediary transfer member, in the primary transfer nip, that is, the first transfer station. This process is sequentially repeated for the magenta, cyan, yellow, and black color images.

To describe the above process more specifically with reference to the magenta image developing device 5, the magenta developing device 5 comprises a sleeve 5*a,* a toner scraper roller 5*c* which rotates in the same direction as the sleeve 5*a,* an elastic blade 5*b,* and the like. It contains negatively chargeable nonmagnetic toner composed of a single component, and charges the toner while uniformly coating the toner on the peripheral surface of the sleeve 5*a.* As development bias, which is "negative" relative to the potential level of the photosensitive member 1 is applied to the sleeve 5*a,* the latent image is reversely developed. The toner which remains on the photosensitive member 1 after the primary transfer is recovered into a cleaner 17.

The image formation speed Vp (process speed) is set at 10.0 cm/sec. A process similar to the process described in the foregoing paragraph is carried out for the rest of the colors to form four color images of a different color on the intermediary transfer member 9, and then, the four color images are transferred all at once onto the transfer material 18 (second transfer process), in the secondary transfer nip, that is, the second transfer station. These processes are also the same as those described regarding the image forming apparatus based on the prior art.

Next, the structure of the intermediary transfer belt 9, and the first and secondary transfer processes, in this embodiment will be described in detail.

First, the intermediary transfer belt 9 will be described. The intermediary transfer belt 9 is in the form of a seamless cylinder, and is 1 mm in thickness, 220 mm in width, and approximately 140 mm in circumference. It is formed by seamlessly extruding NBR rubber (nitrile butadiene rubber), the resistance of which has been adjusted to approximately $5\times10^8$ ohm.cm by the addition of carbon, titanium oxide, tin oxides, and/or the like, and the hardness of which is approximately 60 deg. in JIS-A scale (JIS K6301 Duro A type: the hardness of a test piece was measured under a load of 1 kg).

Further, the intermediary transfer belt 9 is stretched around a driver roller 15, a tensioner roller 16, and a secondary transfer counter-roller 12 as a supporting member. Between the tensioner roller 16 and the counter-roller 12, a cleaner 13 which removes the residual toner on the belt, and a counter-roller 14 which counters the cleaner 13, are disposed.

In the first transfer station, a primary transfer roller 10, which is the first transferring means, is disposed on form an approximately 5 mm wide primary transfer nip so that the intermediary transfer belt 9 is placed flatly in contact with the OPC type photosensitive drum 1 with a diameter of approximately 47 mm. The primary transfer roller 10 is an EPDM rubber roller (ethylene-propylene rubber), and is 8 mm in diameter, and no more than $10^4$ ohm.cm in volumetric resistivity. In order to obtain a value $R_1$ of the combined resistance of the primary transfer roller 10 and the intermediate transfer belt 9 in the primary transfer nip, the photosensitive drum 1 was replaced with a dummy metallic drum having the same diameter as the photosensitive drum 1, and the current which flows between the primary transfer roller 10 and the dummy metallic drum when a predetermined voltage was applied was measured using a detecting means 50. Then, the combined resistance value $R_1$ was calculated from the detected current value. The thus obtained combined resistance value $R_1$ was approximately $5\times10^7$ ohm.

In the second transfer station, a secondary transfer roller 11 as a contact member was pressed upon a counter-roller 12, with an overall pressure of 500 g, the intermediary transfer belt 9 being interposed between the secondary transfer roller 11 and the counter-roller 12. The secondary transfer roller 11 was a PDM rubber roller. It was 16 mm in diameter, and had a hardness of 25 deg. (measured in ASCAR scale under a load of 500 g), and a resistance value in a medium range. The counter-roller 12 was a metallic roller and had a diameter of 22 mm. Further, it was grounded. With this arrangement, an approximately 3 mm wide secondary transfer nip was formed in the secondary transfer station. With the provision of the above arrangement, the value $R_2$ of the resistance between the secondary transfer roller 11 and the counter-roller 12, with the intermediary transfer belt 9 being interposed between the two rollers 11 and 12, was measured under a high temperature-high humidity condition (temperature: 32.5° C.; humidity: 85%). More specifically, the current, which flows between the secondary transfer roller 11 and the counter-roller 12 through the intermediary transfer belt 9 interposed between the two rollers 11 and 12 while applying 500 V between the two rollers 11 and 12 and rotating the intermediary transfer belt 9 at the image formation speed, was measured. Then, the value of the resistance $R_2$ was calculated from the detected current value. The thus obtained value of the resistance $R_2$ between the two rollers 11 and 12 was approximately $3\times10^7$ ohm. The resistance value of the intermediary transfer belt 9 is obtained simply by subtracting the resistance values of the secondary transfer roller 11 and the counter-roller 12 from the value of the resistance $R_2$.

Next, the combined resistance value of the secondary transfer roller 11 and the counter-roller 12 was measured under the aforementioned condition (temperature: 32.5° C.; humidity: 85%). More specifically, a voltage of 50 V was applied between the secondary transfer roller 11 and the counter-roller 12 without interposing the intermediary transfer belt 9, and the current which flows between the two rollers 11 and 12 was measured to calculate the combined resistance value of the two rollers exclusive of the resistance value of the intermediary transfer belt 9. The combined resistance value of the two rollers 11 and 12 thus obtained was $5\times10^4$ ohm. In this embodiment, a metallic roller was used as the counter-roller 12, and therefore, the resistance value of the counter-roller 12 can be approximated as zero. Thus, the resistance value of $5\times10^4$ ohm obtained using the above method can be considered substantially equal to the resistance value of the secondary transfer roller 11. In other words, the combined resistance value of the two rollers 11 and 12 exclusive of the resistance value of the intermediary transfer belt 9 is negligible in comparison to the value of the resistance $R_2$, and therefore, the value of the resistance $R_2$ may be substituted for the resistance value of the intermediary transfer belt 9.

In other words, in order to enable the value of the resistance $R_2$ to be used as an approximate resistance value of the intermediary transfer belt 9, the resistance values of the secondary transfer roller 11 and the counter-roller 12 themselves must be prevented from derogatorily affecting the resistance value of the intermediary transfer belt 9. In order to accomplish this, it is necessary to render the combined resistance value of the two rollers 11 and 12 in the secondary transfer nip sufficiently small relative to the resistance value of the intermediary transfer belt 9 itself. More specifically, the combined resistance value of the two rollers 11 and 12 has only to be made to be approximately one tenth or less of the resistance value of the intermediary transfer belt 9. With this arrangement, the aforementioned value of the resistance $R_2$ may be substituted for the approximate resistance value of the intermediary transfer belt 9. If the combined resistance value of the two rollers 11 and 12 is larger than the one tenth of the resistance value of the intermediary transfer belt 9, the difference in resistance among secondary transfer rollers, nonuniformity in resistance of an individual transfer roller in the circumferential direction, and/or the like greatly affect the results of the calculation, and therefore, it is impossible to accurately calculate the resistance value of the intermediary transfer belt 9.

As for controlling timing for obtaining an optimum secondary transfer voltage, it is desirable to be executed, for example, prior to an actual printing operation. With such timing, the interference between the secondary transfer and the primary transfer is not so conspicuous, and therefore, the biases to be applied to the primary charging device 2 and the primary transfer roller 10, respectively, may be either on or off. However, in order to simultaneously carry out the process for clearing the photosensitive drum 1 of charge or the like processes, the primary charging device is desired to be kept on.

Next, a method for obtaining the optimum secondary transfer voltage using the detecting means 30 will be described. First, the secondary transfer roller 11 is placed in contact with the intermediary transfer belt 9 by a pressing means, in order to measure the voltage.

Figure 2:
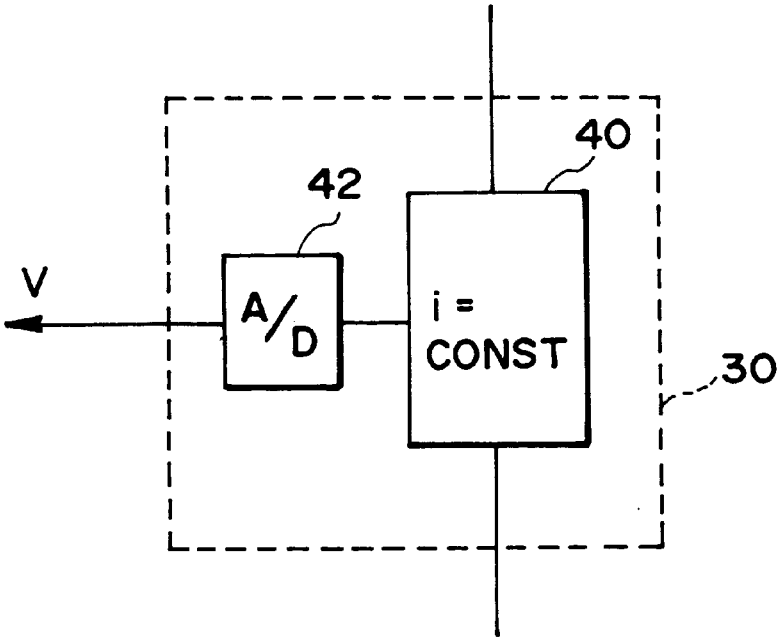
FIG. 2 is a schematic drawing which depicts the constant current supplying means provided in the image forming apparatus illustrated in FIG. 1.

Next, referring to FIG. 2, secondary transfer bias is applied to the intermediary transfer belt 9 using the constant current supplying means 40 of the detecting means 30 for a duration in which any given point on the intermediary transfer belt 9 rotates one rotation or more. During this period, the voltage value is measured and outputted to a CPU 31 through an A/D converter 42. As a result, the CPU 31 calculates and stores the resistances of the intermediary transfer belt 9 in terms of the resistance correspondent to a full circumference; it is desirable that the average value of the stored resistances is used as the resistance value for the intermediary transfer belt 9. It should be noted here that the relationship between the current and the voltage in elastic rubber which is generally employed as the material for the intermediary transfer belt 9 or the like is not linear in many cases, and therefore, it is desirable that the resistance value correspondent to a voltage close to the voltage which will be actually used, is used.

In the case of the secondary transfer in this embodiment, it has been known that the optimum secondary transfer voltage is such a voltage that is present when a secondary transfer current of approximately 20 $\mu$A is flowed between the secondary transfer roller 11 and the counter-roller 12 under the condition in which there is no toner on the intermediary transfer belt 9 and no sheet is passing through the nip. Therefore, all that is necessary to provide the optimum secondary transfer voltage is to detect voltage no later than just prior to the secondary transfer while executing control so that current flows at a constant 20 $\mu$A to calculate the average value of the detected voltage through the CPU 31, to store the average value in the CPU, and to drive the high voltage power source so that a voltage equal to the stored average value is delivered.

In this embodiment, the secondary transfer voltage $V_{T2}$ obtained as described above was 600 V, and when this voltage was used, desirable secondary transfer could be carried out.

Embodiment 2

Figure 3:
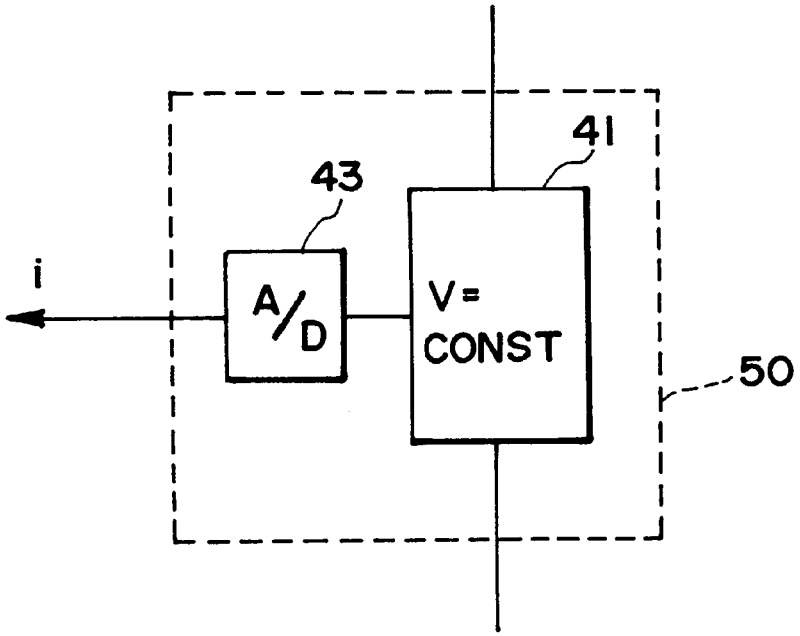
FIG. 3 is a schematic drawing which depicts the constant current supplying means in the second embodiment of the present invention.

Next, the second embodiment of the present invention will be described. In this embodiment, the resistance value of the intermediary transfer belt 9 is obtained with the use of a detecting means 50 comprising a constant voltage supplying means 41 and an A/D converter 43 as illustrated in FIG. 3. As compared to the first embodiment, the detecting means 50 is used in place of the detecting means 30 illustrated in FIG. 2. In this case, a certain voltage value that is likely to be actually used as the value for the secondary transfer voltage is selected in advance as a secondary transfer voltage $V_{T0}$ from a voltage range of 500 V–4 kV, and the current is detected at the prior to the secondary transfer while applying a voltage having this value to the secondary transfer roller 11. The optimum secondary transfer voltage $V_T$ is calculated by the CPU 31 based on the following equation:

$$R=V_{T0}/i_T$$

i: detected current value

When the thus obtained secondary transfer voltage $V_T$ was used, desirable secondary transfer operation could be carried out.

Further, a proper secondary transfer voltage $V_T$ is calculated from the following equation:

$$V_T=R\cdot i_{Ta}$$

$i_{Ta}$: proper current necessary for secondary transfer, for example, $i_{Ta}$=20 $\mu$A In this case, however, unless the relationship between the current which flows through the intermediary transfer belt 9 and the voltage which is applied to the intermediary transfer belt 9 is linear, a voltage value for properly controlling a secondary transfer process sometimes cannot be predicted. In such cases, it is desirable to employ a control method such as the aforementioned method depicted in FIG. 2.

It should be noted here that even though FIGS. 2 and 3 were used for the sake of simplification of description, it is possible to substitute a power source 20 for the power sources 40 and 41 of the control circuit illustrated in FIGS. 2 and 3.

Embodiment 3

Next, the third embodiment of the present invention will be described. In the first and second embodiments, such methods in which the resistance value of the intermediary transfer belt 9 is accurately calculated by detecting the voltage or current between the secondary transfer roller 11 and the counter-roller 12 while flowing a predetermined current or applying a predetermined voltage, respectively, between the secondary transfer roller 11 and the counter-roller 12, and the bias applied during secondary transfer is controlled in response to the thus calculated resistance value of the intermediary transfer belt 9 were described. It is possible to apply these methods to find a proper bias value (bias to be applied from the power source 35) for the primary transfer roller 10 illustrated in FIG. 4. Next, an example of such applications will be described.

In this embodiment, a primary transfer voltage value for desirably carrying out a primary transfer operation is such a voltage value that is capable of flowing a primary transfer current of approximately 10 $\mu$A, with the photosensitive drum 1 holding a charge of approximately −600 V (correspondent to a dark spot). On the other hand, the amount of the primary transfer current is determined by both the electrostatic capacity of the photosensitive drum 1 and the resistance value of the intermediary transfer belt 9 as described pertaining to the method in accordance with the prior art. In other words, when the resistance of the intermediary transfer belt 9 is small, it is only necessary to apply the primary transfer voltage having the value determined by the electrostatic capacity of the photosensitive drum 1, whereas when the resistance value of the intermediary transfer belt 9 is substantially the same as, or slightly larger than, the apparent resistance value of the photosensitive drum 1 (actually, flow into the capacitance component), it is only necessary to apply a primary transfer voltage having a value which includes the value of the voltage drop caused by the resistance of the intermediary transfer belt 9.

That is, it is necessary only to give the primary transfer power source 35 such a structure that limits voltage drop. More specifically, a primary transfer voltage $V_{T1}$ can be calculated from the following equations (1) and (2) using the value of $V_{Ta}$ obtained by executing control in the second transfer station.

$$\text{When } V_{T2}<V_2,\ V_{T1}=V_1\ (V_1 \text{ and } V_2\text{: constant}) \quad (1)$$

$$\text{When } V_{T2}>V_2,\ V_{T1}=V_1+\alpha\times V_{T2}\ (\alpha\text{: constant}) \quad (2)$$

In this embodiment, desirable results could be obtained when $V_1$ was set at 200 V; $V_2$, at 330 V; and $\alpha$ was set at 0.6.

In second transfer, there are cases in which more desirable results can be obtained by gradually increasing the primary transfer voltage each time one of the first to fourth toner images of a different color is superimposed on the intermediary transfer belt 9. In such cases, the bias amount $\Delta V$ by which the primary transfer voltage is increased may be calculated using, for example, the following equation:

$$\Delta V=\beta\cdot V_{T2}\ (\beta\text{: constant}) \quad (3)$$

For example, when the primary transfer voltage for the first color is $V_{T1}$ (V), the second, third, and fourth colors are $V_{T1}+\Delta V$, $V_{T1}+2\cdot\Delta V$, and $V_{T1}+3\cdot\Delta V$, correspondingly.

Next, the fourth embodiment of the present invention will be described with reference to FIG. 4. There are other methods for controlling various processing means using the resistance value of the intermediary transfer belt 9, or the second transfer bias value, obtained using the secondary transfer roller, than the methods described in the preceding embodiments.

In the case of the image forming apparatus illustrated in FIG. 1, a contact type charging roller 2 is connected to a bias power source 33; a development sleeve 5*a,* to a bias power source 34; a primary transfer roller 10, to a bias power source 35; and a cleaning assisting roller 32 is connected to a bias power source 36. The bias power sources 33, 34, 35 and 36 are connected to a CPU 31.

Figure 4:
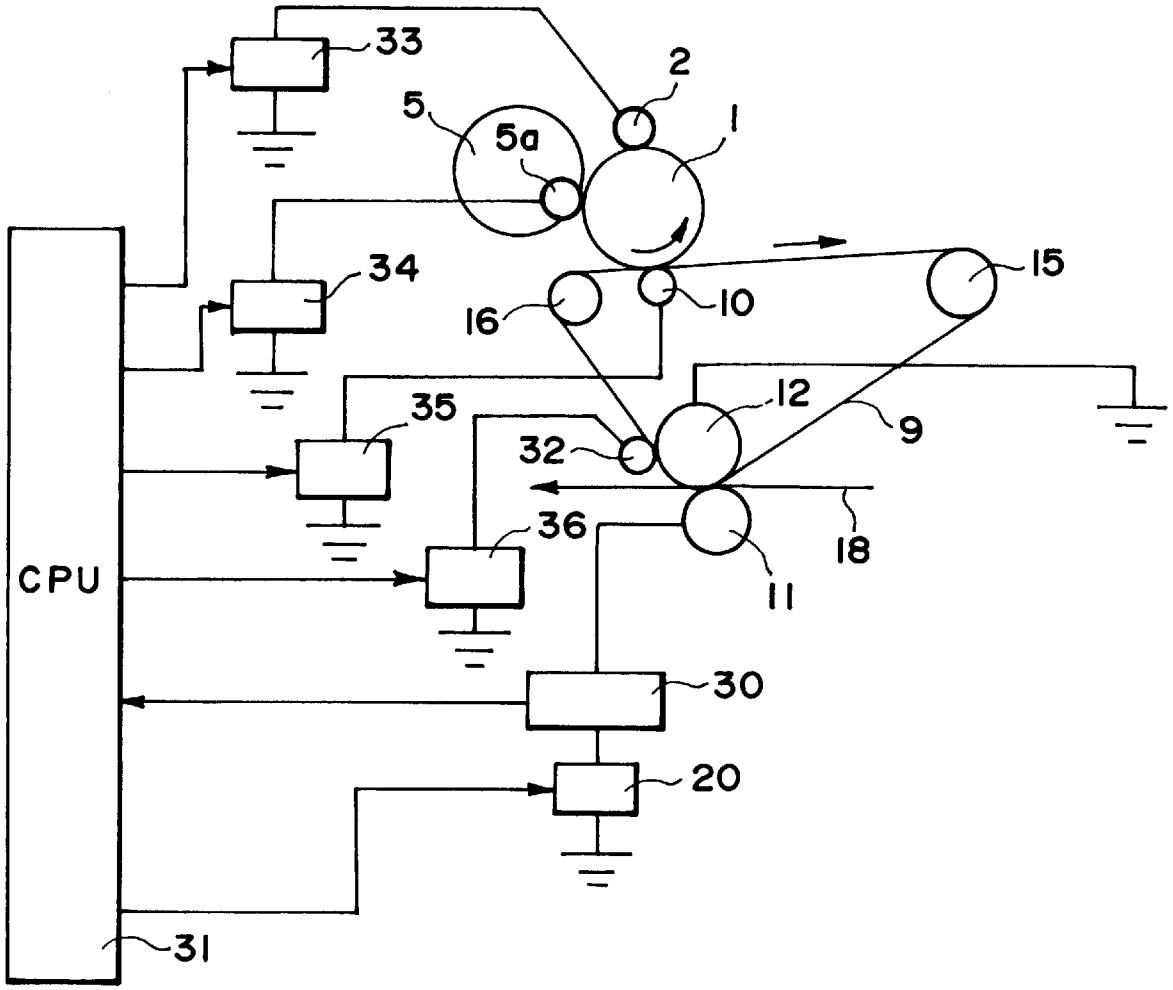
FIG. 4 is a schematic elevation of the image forming apparatus in the third and fourth embodiments of the present invention.
Figure 5:
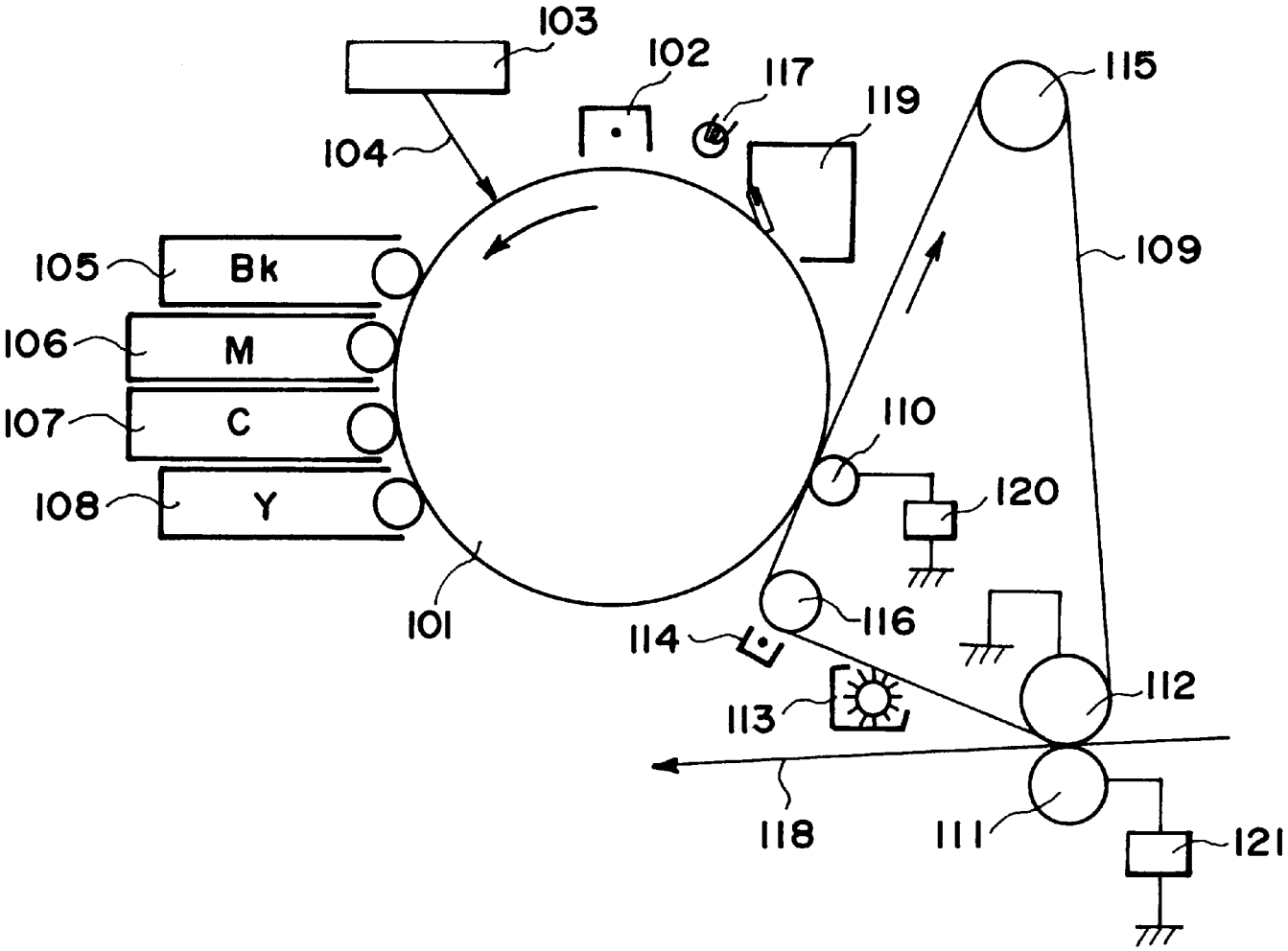
FIG. 5 is a schematic elevation of an image forming apparatus based on the prior art.

As depicted in FIG. 4, in the image forming apparatus in this embodiment, the cleaning assisting roller 32 (hereinafter, ICL 32) is disposed in contact with the intermediary transfer belt 9, adjacent to and past the second transfer station. It gives positive charge to the toner which remains on the intermediary transfer belt 9 after second transfer (hereinafter, post-secondary transfer residual toner), so that the post-secondary transfer residual toner is transferred back onto the photosensitive drum 1 in the first transfer station. With this arrangement, the cleaning means 13 for the intermediary transfer belt 9, illustrated in FIG. 1, is unnecessary.

More specifically, the post-secondary transfer residual toner, which has been charged to the positive polarity by the ICL 32, is transferred back onto the photosensitive drum 1 by an electric field generated at the primary transfer nip, that is, the primary transfer electric field generated at the interface between the photosensitive drum 1 and the primary transfer roller 10, and then, is recovered by cleaner 17 for the photosensitive drum 1. In other words, the following toner image formed on the photosensitive drum 1 is transferred onto the intermediary transfer belt 9 by the aforementioned primary transfer electric field at the same time as the post-secondary transfer residual toner from the preceding toner image is transferred back onto the photosensitive member 1. As a result, image formation throughput is improved.

This ICL 32 is pressed upon the counter-roller 12, with the intermediary transfer belt 9 being interposed between the two rollers. In other words, the counter-roller 12 is shared as common counter-electrode by the secondary transfer roller 11 and the ICL 32 to simplify the structure. In order to charge the post-secondary transfer residual toner to a proper level by using the ICL 32 in this embodiment, it is desirable to flow approximately 25 $\mu$A through the ICL 32.

The resistance value of the ICL 32 is $5\times10^4$ ohm (actual resistance when foamed EPDM rubber is used as the material), which is sufficiently small relative to the resistance value of the intermediary transfer belt 9. The width of the nip between the ICL 32 and the counter-roller 12 is approximately 1 mm. Therefore, a proper voltage $V_C$ (V) to be applied to the ICL 32 is approximately $3\times V_{T2}$.

In the foregoing paragraph, the methods for controlling the primary transfer roller 10 and the ICL 32 were described. However, it is possible to optimize the amount of the toner transferred onto the photosensitive drum 1 during development, by adjusting the bias applied to the contact type charge roller 2, the development sleeve 5*a,* and the like, in response to the value of $V_{T2}$. In other words, it is possible to facilitate toner transfer by reducing the amount of the toner transferred onto the photosensitive drum 1 during development as the resistance value of the intermediary transfer belt 9 increases due to environmental changes.

It should be noted here that the present invention is not limited by the structure of an intermediary transfer member; it is obvious that the present invention is applicable to an intermediary transfer drum comprising a base drum and an elastic layer, just as effectively as it is to an intermediary transfer belt.

Further, in the preceding embodiments, the voltage between the secondary transfer roller 11 and the counter-roller 12, or the current which flows between the two rollers 11 and 12, was detected while flowing a predetermined current, or applying a predetermined voltage, between the two rollers 11 and 12. However, application of the present invention is not limited to such an arrangement; the position at which the voltage or current is detected does not need to be the second transfer station. When the voltage or current detecting position is not the second transfer station, the aforementioned voltage or current should be detected by placing at the detecting position a pair of mutually pressing members, with an intermediary transfer member being interposed between the pressing members, as described in the preceding embodiments. It is obvious, in such a case, that the combined resistance value of the pair of mutually pressing members should be one tenth of the resistance value of the intermediary transfer member.

As is evident from the descriptions given above, according to the present invention, it is possible to obtain such detection results that accurately reflect the environmentally induced fluctuation of the resistance value of an intermediary transfer member. Therefore, it is possible to optimally control not only the transfer related conditions, but also image formation related other conditions to always produce desirable images.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member for bearing an image;

an intermediary transfer member onto which an image is transferred from said image bearing member at a first transfer position;

a contact member, contactable to an image receiving side of said intermediary transfer member, for transferring the image from said intermediary transfer member onto a transfer material at a second transfer position;

a supporting member of metal, disposed opposite said contact member at said second transfer position with said intermediary transfer member therebetween, for supporting said intermediary transfer member, wherein a sum of a resistance value of said contact member and a resistance value of said supporting member is not more than one-tenth of a resistance value of said intermediate transfer member;

current supplying means for supplying a predetermined current between said contact member and said supporting member;

voltage detecting means for detecting a voltage when the predetermined current is supplied between said contact member and said supporting member through said intermediary transfer member, said contact member and said supporting member are contacted to said intermediary transfer member, and the transfer material is not at said second transfer position; and control means for controlling a voltage applied to said contact member in accordance with an output of said voltage detecting means, when the image is transferred onto the transfer material from said intermediary transfer member.

2. An apparatus according to claim 1, wherein said contact member effects transfer of the image from said intermediary transfer member onto the transfer material at the second transfer position.

3. An apparatus according to claim 2, wherein said contact member includes a roller.

4. An apparatus according to claim 3, wherein said supporting member includes a roller.

5. An apparatus according to claim 3, wherein said supporting member is a base supporting said intermediary transfer member.

6. An apparatus according to claim 1, wherein said voltage detecting means detects the voltage a plurality of times when said intermediary transfer member rotates through one full turn, and wherein said control means controls the voltage applied to said contact in accordance with outputs corresponding to the plurality of detections.

7. An apparatus according to claim 2, wherein a voltage applied to said contact member during image transfer onto the transfer material is controlled on the basis of the voltage detected before the image is transferred onto the transfer material from said intermediary transfer member by said contact member.

8. An apparatus according to claim 1, further comprising developer charging means for electrically charging remaining developer remaining on said intermediary transfer member after the image transfer onto the transfer material to transfer the residual developer on the image bearing member at said first transfer position, wherein a voltage applied to said developer charging means is controlled on the basis of the detected voltage.

9. An apparatus according to claim 1, further comprising transfer means for transferring the image from said image bearing member onto said intermediary transfer member at the first transfer position, wherein a voltage applied to said transfer means is controlled on the basis of the detected voltage.

10. An apparatus according to claim 9, wherein said image bearing member is capable of carrying images of different colors, and the voltage applied to said transfer means is increased each time the image is superimposedly transferred onto the intermediary transfer member at said first transfer position from said image bearing member, wherein an amount of the increase is controlled on the basis of the detected voltage.

11. An apparatus according to claims 1, 3, 7, 8, 9 or 10, wherein said image bearing member is capable of carrying images of different colors, and the images are sequentially and superimposedly transferred onto said intermediary transfer member at said first transfer position from said image bearing member, and the images of different colors are all together transferred onto the transfer material from said intermediary transfer member at said second transfer position.

12. An image forming apparatus comprising:

an image bearing member for bearing an image;

an intermediary transfer member onto which an image is transferred from said image bearing member at a first transfer position;

a contact member, contactable to an image receiving side of said intermediary transfer member, for transferring the image from said intermediary transfer member onto a transfer material of a second transfer position;

a supporting member of metal, disposed opposite said contact member at said second transfer position with said intermediary transfer member therebetween, for supporting said intermediary transfer member, wherein a sum of a resistance value of said contact member and a resistance value of said supporting member is not more than one-tenth of a resistance value of said intermediary transfer member;

voltage applying means for supplying a predetermined voltage between said contact member and said supporting member;

current detecting means for detecting a current when the predetermined voltage is applied between said contact member and said supporting member through said intermediary transfer member, said contact member and said supporting member are contacted to said intermediary transfer member, and the transfer material is not present at the said secondary transfer position; and control means for controlling a voltage applied to said contact member in accordance with an output of said current detecting means, when the image is transferred onto the transfer material from said intermediary transfer member.

13. An apparatus according to claim 12, wherein said contact member effects transfer of the image from said intermediary transfer member onto the transfer material at the second transfer position.

14. An apparatus according to claim 13, wherein said contact member includes a roller.

15. An apparatus according to claim 14, wherein said supporting member includes a roller.

16. An apparatus according to claim 14, wherein said supporting member is a base supporting said intermediary transfer member.

17. An apparatus according to claim 12, wherein said current detecting means detects the current a plurality of times when said intermediary transfer member rotates through one full turn, and wherein said control means controls the voltage applied to said contact member in accordance with outputs corresponding to the plurality of detections.

18. An apparatus according to claim 13, wherein a voltage applied to said contact member during image transfer onto the transfer material is controlled on the basis of the current detected before the image is transferred onto the transfer material from said intermediary transfer member by said contact member.

19. An apparatus according to claim 12, further comprising developer charging means for electrically charging remaining developer remaining on said intermediary transfer member after the image transfer onto the transfer material to transfer the residual developer on the image bearing member at said first transfer position, wherein a voltage applied to said developer charging means is controlled on the basis of the detected current.

20. An apparatus according to claim 12, further comprising transfer means for transferring the image from said image bearing member onto said intermediary transfer member at the first transfer position, wherein a voltage applied to said transfer means is controlled on the basis of the detected current.

21. An apparatus according to claim 20, wherein said image bearing member is capable of carrying images of different colors, and the voltage applied to said transfer means is increased each time the image is superimposedly transferred onto the intermediary transfer member at said first transfer position from said image bearing member, wherein an amount of the increase is controlled on the basis of the detected current.

22. An apparatus according to claims 12, 14, 15, 16, 18, 19, 20 or 21, wherein said image bearing member is capable of carrying images of different colors, and the images are sequentially and superimposedly transferred onto said intermediary transfer member at said first transfer position from said image bearing member, and the images of different colors are all together transferred onto the transfer material from said intermediary transfer member at said second transfer position.

23. An image forming apparatus comprising:

an image bearing member for bearing an image;

an intermediary transfer member;

transfer means for transferring the image from said image bearing member onto said intermediary transfer member at a first transfer position, the image on said intermediary transfer member being transferred onto a transfer material at a second transfer station;

a contact member provided at an image bearing side of said intermediary transfer member, said contact member being capable of forming a nip with said intermediary transfer member;

a supporting member for supporting said intermediary transfer member at a position opposite from the nip, wherein a sum of a resistance value of said contact member and a resistance value of said supporting member is not more than one-tenth of a resistance value of said intermediary transfer member;

current supplying means for supplying a predetermined current between said contact member and said supporting member;

a voltage detecting means for detecting a voltage when the predetermined current is supplied between said contact member and said supporting member through said intermediary transfer member, said contact member and said supporting member are contacted to said intermediary transfer member, and the transfer material is not at said nip; and control means for controlling a voltage applied to said transfer means in accordance with an output of said voltage detecting means, when the image is transferred from said image bearing member onto said intermediary transfer member.

24. An apparatus according to claim 23, wherein said nip is formed at said second transfer position, and wherein said contact member effects transfer of the image from said intermediary transfer member onto the transfer material at said second transfer position.

25. An apparatus according to claim 24, wherein said contact member includes a roller.

26. An apparatus according to claim 25, wherein said supporting member includes a roller.

27. An apparatus according to claim 26, wherein said supporting member is an electroconductive member.

28. An apparatus according to claim 27, wherein said supporting member is of metal.

29. An apparatus according to claim 25, wherein said supporting member is a base supporting said intermediary transfer member.

30. An apparatus according to claim 29, wherein said supporting member is an electroconductive member.

31. An apparatus according to claim 30, wherein said supporting member is of metal.

32. An apparatus according to claim 24, wherein a voltage applied to said contact member during image transfer onto the transfer material is controlled on the basis of the voltage detected by said voltage detecting means before the image is transferred onto the transfer material from said intermediary transfer member by said contact member.

33. An apparatus according to claim 23, further comprising developer charging means for electrically charging remaining developer remaining on said intermediary transfer member after the image transfer onto the transfer material to transfer the residual developer to the image bearing member at said first transfer position, wherein a voltage applied to said developer charging means is controlled on the basis of the detected voltage by said voltage detecting means.

34. An apparatus according to claim 23, wherein said image bearing member is capable of carrying images of different colors, and the voltage applied to said transfer means is increased each time the image is superimposedly transferred onto the intermediary transfer member at said first transfer position from said image bearing member, wherein an amount of the increase is controlled on the basis of the detected voltage by said voltage detecting means.

35. An apparatus according to claim 23, wherein said voltage detecting means detects the voltage a plurality of times when said intermediary transfer member rotates through one full turn, and wherein said control means controls the voltage applied to said transfer means in accordance with outputs corresponding to the plurality of detections.

36. An apparatus according to any one of claims 23 through 35, wherein said image bearing member is capable of carrying images of different colors, the images are sequentially and superimposedly transferred onto said intermediary transfer member at said first transfer position from said image bearing member, and the images of different colors are all together transferred onto the transfer material from said intermediary transfer member at said second transfer position.

37. An image forming apparatus comprising:

an image bearing member for bearing an image;

an intermediary transfer member;

transfer means for transferring the image from said image bearing member onto said intermediary transfer member at a first transfer position, the image on said intermediary transfer member being transferred onto a transfer material at a second transfer station;

a contact member provided at an image bearing side of said intermediary transfer member, said contact member being capable of forming a nip with said intermediary transfer member;

a supporting member for supporting said intermediary transfer member at a position opposite from the nip, wherein a sum of a resistance value of said contact member and a resistance value of said supporting member is not more than one-tenth of a resistance value of said intermediary transfer member;

voltage applying means for applying a predetermined voltage between said contact member and said supporting member;

a current detecting means for detecting a current when the predetermined voltage is supplied between said contact member and said supporting member through said intermediary transfer member, said contact member and said supporting member are contacted to said intermediary transfer member, and the transfer material is not at said nip; and control means for controlling a voltage applied to said transfer means in accordance with an output of said current detecting means, when the image is transferred from said image bearing member onto said intermediary transfer member.

38. An apparatus according to claim 37, wherein said nip is formed at said second transfer position, and wherein said contact member effects transfer of the image from said intermediary transfer member onto the transfer material at said second transfer position.

39. An apparatus according to claim 38, wherein said contact member includes a roller.

40. An apparatus according to claim 39, wherein said supporting member includes a roller.

41. An apparatus according to claim 40, wherein said supporting member is an electroconductive member.

42. An apparatus according to claim 41, wherein said supporting member is of metal.

43. An apparatus according to claim 39, wherein said supporting member is a base supporting said intermediary transfer member.

44. An apparatus according to claim 43, wherein said supporting member is an electroconductive member.

45. An apparatus according to claim 44, wherein said supporting member is of metal.

46. An apparatus according to claim 38, wherein a voltage applied to said contact member during image transfer onto the transfer material is controlled on the basis of the voltage detected by said current detecting means before the image is transferred onto the transfer material from said intermediary transfer member by said contact member.

47. An apparatus according to claim 37, further comprising developer charging means for electrically charging remaining developer remaining on said intermediary transfer member after the image transfer onto the transfer material to transfer the residual developer to the image bearing member at said first transfer position, wherein a voltage applied to said developer charging means is controlled on the basis of the detected voltage by said current detecting means.

48. An apparatus according to claim 37, wherein said image bearing member is capable of carrying images of different colors, and the voltage applied to said transfer means is increased each time the image is superimposedly transferred onto the intermediary transfer member at said first transfer position from said image bearing member, wherein an amount of the increase is controlled on the basis of the detected voltage by said current detecting means.

49. An apparatus according to claim 37, wherein said current detecting means detects the voltage a plurality of times when said intermediary transfer member rotates through one full turn, and wherein said control means controls the voltage applied to said transfer means in accordance with outputs corresponding to the plurality of detections.

50. An apparatus according to any one of claims 37 through 49, wherein said image bearing member is capable of carrying images of different colors, and the images are sequentially and superimposedly transferred onto said intermediary transfer member at said first transfer position from said image bearing member, and the images of different colors are all together transferred onto the transfer material from said intermediary transfer member at said second transfer position.

51. An image forming apparatus comprising:

an image bearing member for bearing an image;

an intermediary transfer member onto which an image is transferred from said image bearing member at a first transfer position and from which the image thus transferred is transferred onto a transfer material at a second transfer position;

a contact member provided at an image bearing side of said intermediary transfer member, said contact member being capable of forming a nip with said intermediary transfer member;

a supporting member for supporting said intermediary transfer member at a position opposite from the nip, wherein a sum of a resistance value of said contact member and a resistance value of said supporting member is not more than one-tenth of a resistance value of said intermediary transfer member;

developer charging means for electrically charging remaining developer remaining on said intermediary transfer member after the image transfer onto the transfer material to transfer the residual developer to the image bearing member at said first transfer position;

current supplying means for supplying a predetermined current between said contact member and said supporting member;

a voltage detecting means for detecting a voltage when the predetermined current is supplied between said contact member and said supporting member through said intermediary transfer member when said contact member and said supporting member are contacted to said intermediary transfer member, and the transfer material is not at said nip; and control means for controlling a voltage applied to said transfer means in accordance with an output of said voltage detecting means when a residual developer is charged.

52. An apparatus according to claim 51, wherein said nip is formed at said second transfer position, and wherein said contact member effects transfer of the image from said intermediary transfer member onto the transfer material at said second transfer position.

53. An apparatus according to claim 52, wherein said contact member includes a roller.

54. An apparatus according to claim 53, wherein said supporting member includes a roller.

55. An apparatus according to claim 54, wherein said supporting member is an electroconductive member.

56. An apparatus according to claim 55, wherein said supporting member is of metal.

57. An apparatus according to claim 53, wherein said supporting member is a base supporting said intermediary transfer member.

58. An apparatus according to claim 57, wherein said supporting member is an electroconductive member.

59. An apparatus according to claim 58, wherein said supporting member is of metal.

60. An apparatus according to claim 52, wherein a voltage applied to said contact member during image transfer onto the transfer material is controlled on the basis of the voltage detected by said current detecting means before the image is transferred onto the transfer material from said intermediary transfer member by said contact member.

61. An apparatus according to claim 51, further comprising transfer means for transferring the image from said image bearing member onto said intermediary transfer member at said first transfer position, wherein a voltage applied on said transfer means is controlled on the basis of the detected voltage by said current detecting means.

62. An apparatus according to claim 61, wherein said image bearing member is capable of carrying images of different colors, and the voltage applied to said first transfer means is increased each time the image is superimposedly transferred onto the intermediary transfer member at said first transfer position from said image bearing member, wherein an amount of the increase is controlled on the basis of the detected voltage by said current detecting means.

63. An apparatus according to claim 51, wherein said voltage detecting means detects the voltage a plurality of times when said intermediary transfer member rotates through one full turn, and wherein said control means controls the voltage applied to said developing means in accordance with outputs corresponding to the plurality of detections.

64. An apparatus according to claim 51, wherein simultaneously with the residual toner charged by said developer charging means being transferred onto said image bearing member at said first transfer position, an electric field for transferring a next image from said image bearing member onto said intermediary transfer member is formed.

65. An apparatus according to claim 51, wherein said developer charging means is disposed opposite said supporting member with said intermediary transfer member therebetween.

66. An apparatus according to any one of claims 51 through 54, wherein said image bearing member is capable of carrying images of different colors, and the images are sequentially and superimposedly transferred onto said intermediary transfer member at said first transfer position from said image bearing member, and the images of different colors are all together transferred onto the transfer material from said intermediary transfer member at said second transfer position.

67. An image forming apparatus comprising:

an image bearing member for bearing an image;

an intermediary transfer member onto which an image is transferred from said image bearing member at a first transfer position and from which the image thus transferred is transferred onto a transfer material at a second transfer position;

a contact member provided at an image bearing side of said intermediary transfer member, said contact member being capable of forming a nip with said intermediary transfer member;

a supporting member for supporting said intermediary transfer member at a position opposite from the nip, wherein a sum of a resistance value of said contact member and a resistance value of said supporting member is not more than one-tenth of a resistance value of said intermediary transfer member;

developer charging means for electrically charging remaining developer remaining on said intermediary transfer member after the image transfer onto the transfer material to transfer the residual developer to the image bearing member at said first transfer position;

voltage applying means for applying a predetermined voltage between said contact member and said supporting member;

a current detecting means for detecting a current when the predetermined voltage is supplied between said contact member and said supporting member through said intermediary transfer member when said contact member and said supporting member are contacted to said intermediary transfer member, and the transfer material is not at said nip; and control means for controlling a voltage applied to said developing means in accordance with an output of said current detecting means, when the residual toner is charged.

68. An apparatus according to claim 67, wherein said nip is formed at said second transfer position, said contact member effects transfer of the image from said intermediary transfer member onto the transfer material at said second transfer position.

69. An apparatus according to claim 68, wherein said contact member includes a roller.

70. An apparatus according to claim 69, wherein said supporting member includes a roller.

71. An apparatus according to claim 70, wherein said supporting member is an electroconductive member.

72. An apparatus according to claim 71, wherein said supporting member is of metal.

73. An apparatus according to claim 69, wherein said supporting member is a base supporting said intermediary transfer member.

74. An apparatus according to claim 57, wherein said supporting member is an electroconductive member.

75. An apparatus according to claim 58, wherein said supporting member is of metal.

76. An apparatus according to claim 68, wherein a voltage applied to said contact member during image transfer onto the transfer material is controlled on the basis of the voltage detected by said voltage detecting means before the image is transferred onto the transfer material from said intermediary transfer member by said contact member.

77. An apparatus according to claim 67, further comprising transfer means for transferring the image from said image bearing member onto said intermediary transfer member at said first transfer position, wherein a voltage applied on said transfer means is controlled on the basis of the detected voltage by said voltage detecting means.

78. An apparatus according to claim 77, wherein said image bearing member is capable of carrying images of different colors, and the voltage applied to said first transfer means is increased each time the image is superimposedly transferred onto the intermediary transfer member at said first transfer position from said image bearing member, wherein an amount of the increase is controlled on the basis of the detected voltage by said current detecting means.

79. An apparatus according to claim 67, wherein said voltage detecting means detects the voltage a plurality of times when said intermediary transfer member rotates through one full turn, and wherein said control means controls the voltage applied to said developing means in accordance with outputs corresponding to the plurality of detections.

80. An apparatus according to claim 67, wherein simultaneously with the residual toner charged by said developer charging means being transferred onto said image bearing member at said first transfer position, an electric field for transferring a next image from said image bearing member onto said intermediary transfer member is formed.

81. An apparatus according to claim 67, wherein said developer charging means is disposed opposite said supporting member with said intermediary transfer member therebetween.

82. An apparatus according to any one of claims 67 through 81, wherein said image bearing member is capable of carrying images of different colors, and the images are sequentially and superimposedly transferred onto said intermediary transfer member at said first transfer position from said image bearing member, and the images of different colors are all together transferred onto the transfer material from said intermediary transfer member at said second transfer position.

* * * * *

UNITED STATES PATENT AND TRADEMARK OFFICE

CERTIFICATE OF CORRECTION

PATENT NO. : 5,953,572

DATED : September 14, 1999

INVENTOR(S) : AKIHIKO TAKEUCHI, et al.

It is certified that error appears in the above-identified patent and that said Letters Patent is hereby corrected as shown below:

COLUMN 9:

Line 40, "at the" should read --no later than just--.

COLUMN 13:

Line 18, "contact" should read --contact member--.
Line 19, "detections." should read --times.--.
Line 26, "remain-" should read --residual--.
Line 27, "ing" should be deleted.

COLUMN 14:

Line 39, "detections." should read --times.--.
Line 48, "remaining" should read --residual--.

COLUMN 16:

Line 5, "remaining" should read --residual--.
Line 18, "of the" should read --of--.
Line 25, "detec-" should read --times--.

UNITED STATES PATENT AND TRADEMARK OFFICE

CERTIFICATE OF CORRECTION

PATENT NO. : 5,953,572

DATED : September 14, 1999

INVENTOR(S) : AKIHIKO TAKEUCHI, et al.

It is certified that error appears in the above-identified patent and that said Letters Patent is hereby corrected as shown below:

COLUMN 16:

Line 26, "tions." should be deleted.

COLUMN 17:

Line 29, "remaining" should read --residual--.
Line 49, "detec-" should read --times--.
Line 50, "tions." should be deleted.

COLUMN 18:

Line 12, "remaining" should read --residual--.
Line 27, "transfer" should read --developer charger--.
Line 54, "current" should read --voltage--.
Line 62, "current" should read --voltage--.

COLUMN 19:

Line 3, "current" should read --voltage--.
Line 9, "detections." should read --times.--.
Line 47, "remaining" should read --residual--.

UNITED STATES PATENT AND TRADEMARK OFFICE

CERTIFICATE OF CORRECTION

PATENT NO. : 5,953,572

DATED : September 14, 1999

INVENTOR(S) : AKIHIKO TAKEUCHI, et al.

It is certified that error appears in the above-identified patent and that said Letters Patent is hereby corrected as shown below:

COLUMN 19:

Line 62, "developing" should read --developer charger--.
Line 63, "toner" should read --developer--.

COLUMN 20:

Line 21, "voltage" should read --current--.
Line 22, "voltage" should read --current--.
Line 31, "voltage" (both occurrences) should read --current--.
Line 38, "the" should be deleted.
Line 39, "voltage" should read --current--.
Line 46, "detections." should read --times.--.

Signed and Sealed this

First Day of August, 2000

*Attest:*

Q. TODD DICKINSON

*Attesting Officer*

*Director of Patents and Trademarks*